US005515094A

United States Patent [19]

Tanaka et al.

[11] Patent Number: 5,515,094

[45] Date of Patent: May 7, 1996

[54] INK JET PRINTER

[75] Inventors: Yoshiaki Tanaka, Fujisawa; Takahiro Kawaguchi, Numazu, both of Japan

[73] Assignee: Kabushiki Kaisha TEC, Shizuoka, Japan

[21] Appl. No.: 233,707

[22] Filed: Apr. 26, 1994

[30] Foreign Application Priority Data

Apr. 27, 1993 [JP] Japan ..... 5-100627

[51] Int. Cl.[6] ..... B41J 13/10; B41J 2/01

[52] U.S. Cl. ..... 347/104; 347/8; 400/642; 400/56; 400/58

[58] Field of Search ..... 347/104, 8; 400/625, 400/642, 646, 648, 611, 624, 55, 48, 58, 56, 59; 346/134; 271/188, 209

[56] References Cited

U.S. PATENT DOCUMENTS

| | | | |
|---|---|---|---|
| 4,165,029 | 8/1979 | Mitchell | 347/104 |
| 4,491,854 | 1/1985 | Habelt et al. | 400/434 |
| 4,729,557 | 3/1988 | Kiyohara | 347/104 |
| 5,356,229 | 10/1994 | Hickman et al. | 347/8 |
| 5,356,231 | 10/1994 | Nakamura et al. . | |
| 5,393,151 | 2/1995 | Martin et al. | 347/104 |

FOREIGN PATENT DOCUMENTS 59-14963 1/1984 Japan .

OTHER PUBLICATIONS

Patent Abstracts of Japan, vol. 11, No. 146 (M-587), May 13, 1987, JP-61-280967, Dec. 11, 1986.

Database JAPIO, Japan Patent Information Organization, AN-93-221061, JP-5-221061, Aug. 31, 1993.

*Primary Examiner*—Benjamin R. Fuller

*Assistant Examiner*—Valerie Ann Lund

*Attorney, Agent, or Firm*—Oblon, Spivak, McClelland, Maier & Neustadt

[57] ABSTRACT

A leaf plate is disposed in abutment, through a guide path of printing paper, with a feed roller whose peripheral surface is in contact with the guide path. The printing paper is transported by the feed roller rotationally driven while the printing paper is pressed against the feed roller by the leaf plate. In the course of transportation of the printing paper, the printing paper fed by the feed roller is guided along a flat paper guide surface, and printing is performed by having ink jetted from a nose portion of an ink jet head to the printing paper being guided as described above. Immediately before the printing position in the guide path, there are disposed a plurality of projections in contact with the guide path and at predetermined intervals in the direction transverse to the printing paper. By bringing the transported printing paper into contact with the projections, the amplitude of undulations continuously produced in the printing paper in the direction transverse to the paper is reduced. Thus, the distance between the nose portion of the ink jet head and the printing paper in the printing position is made uniform and the quality of printing is improved.

9 Claims, 10 Drawing Sheets

INK JET PRINTER

BACKGROUND OF THE INVENTION

1. Field of the Invention

The present invention relates to an ink jet printer of a structure in which recording paper is transported through rotation of a feed roller while the paper is pressed against the feed roller by a leaf plate.

2. Description of the Related Art

As conventional ink jet printers widely in use, there are those of a type as shown in FIG. 10, in which, while a carrier 2 with an ink jet head 3 mounted thereon is moved in the direction transverse to printing paper P, which is transported by a paper feed mechanism 5 along a paper guide surface 8, ink is jetted from a nose portion 4 of the ink jet head 3 and printing is thereby performed. More specifically, an ink jet head 3 of a serial type is used and a desired image is formed on the printing paper P through main scanning performed by having such an ink jet head 3 moved by a head slide mechanism, not shown, and sub-scanning performed by having the printing paper P transported by the paper feed mechanism 5. In the example shown in FIG. 10, the paper feed mechanism 5 is constructed of a feed roller 6 rotationally driven by a motor, not shown, and a leaf plate 7 pressing the printing paper P against the feed roller 6.

In more concrete terms, the feed roller 6 is divided into three pieces in the direction transverse to the printing paper P so that its surface of friction with the printing paper P is limited to a minimum that is necessary and, thereby, the load on the motor is reduced. Further, the leaf plate 7 is structured so as to press the printing paper P sent over to the feed roller 6 through automatic or manual paper feeding against the feed roller 6 by its spring force. The leaf plate 7 is shaped, at the place where it faces the paper guide surface 8, to push the transported printing paper P to the paper guide surface 8, in order to secure good flatness of the printing paper P.

FIG. 11 shows a paper guide unit 21 on which the paper guide surface 8 is formed. In the paper guide unit 21, there are formed hollow portions 22 permitting the feed roller 6 divided into three pieces to be positioned therein. The hollow portion 22 extends into the region of the paper guide surface 8.

In the printer of the above described structure, the printing paper P transported to the paper guide surface 8 pressed against the feed roller 6 by the leaf plate 7 is printed with ink jetted from the nose portion 4 of the ink jet head 3, which is reciprocated in the direction transverse to the paper, and then, it is transported along the paper guide surface 8 and discharged into a paper stacker, not shown, on the downstream side.

Problems arising with the above mentioned prior art will be described below. In the ink jet printer, printing is performed with the nose portion of the ink jet head 3 in non-contacting relationship with the printing paper P and, further, very high printing density is required from it. Therefore, in order to improve the printing quality, the distance between the ink jet head 3 and the printing paper P must be maintained constant. However, in the ink jet printer mentioned above, because of the structure of the leaf plate 7 pressing the printing paper P against the feed roller 6, a pressure is applied to the paper and, thereby, undulations, in the form of continuous wave in the direction transverse to the paper, are produced. As a result, a problem arises that the distance between the printing paper P and the ink jet head 3 cannot be maintained constant and, hence, the printing quality is deteriorated. Further, with the apparatus in which the feed roller 6 is divided into a plurality of pieces as illustrated in FIG. 10 and FIG. 11, there are produced portions in the printing paper P to which the transporting force is applied and not applied, and also from such non-uniform application of the transporting force to the printing paper P, the problem of undulations occurring in the printing paper P leading to deterioration in the printing quality arises. Such undulations are also produced by moisture due to attachment of ink to the printing paper P while printing is performed with the ink jet head 3, i.e., especially when high-density printing is performed, there are produced differences in elongation and contraction of the paper on the printing side and the reverse side, and from this, undulations occur in the printing paper P. The undulations produced by the moisture of the ink spread to the surroundings and even reach the printing position. Also from the undulations thus produced, the problem of deterioration in the printing quality arises.

An example of undulations occurring from the above described causes is illustrated in FIG. 12. By the existence of the amplitude of such undulations, the nose portion 4 approaches or separates from the surface of the printing paper P, deviating from a regular distance between the surface of the printing paper P and the nose portion 4 and, thereby, deterioration in the printing quality is produced. The deterioration in the printing quality becomes very noticeable when ruled lines, for example, are printed. Sometimes, even an ink smear is produced on the printing paper P when a ridge portion of the undulation approaches very close to the nose portion 4 of the ink jet head 3. Specifically, as to the undulations produced in the printing paper P by moisture of the ink, the more severe the amplitude becomes, the higher the printing density on the printing paper P becomes. Accordingly, deterioration in the printing quality and ink smears occur frequently.

Applicant has tried to obtain good flatness of the printing paper by increasing the pressure of the leaf plate 7 or more precisely finishing the portion of the paper guide surface 8 shown in FIG. 11, but this was virtually useless.

SUMMARY OF THE INVENTION

A first object of the invention is to provide an ink jet printer capable of reducing the amplitude of undulations produced in the printing paper.

A second object of the invention is to provide an ink jet printer capable of reducing the amplitude of undulations produced in the printing paper from various causes.

A third object of the invention is to provide an ink jet printer of a simple structure capable of reducing the amplitude of undulations produced in the printing paper.

In this invention, a leaf plate is disposed in abutment, through a guide path, against a feed roller whose peripheral surface is in contact with the guide path. Printing paper is guided along the guide plate from the paper supplying position to the paper discharging position. The printing paper is transported by the feed roller being driven rotationally while the printing paper is pressed against the feed roller by the leaf plate. In the course of transportation of the printing paper, the printing paper fed by the feed roller is guided along a flat paper guide surface, and printing is performed by having ink jetted from a nose portion of an ink jet head to the printing paper being guided as described above. Further, in the region between the place where the leaf plate contacts the feed roller and the place where the nose portion of the ink jet printer opposes the paper guide surface, there are disposed a plurality of projections in contact with the guide path at predetermined intervals in the direction transverse to the paper, so that the amplitude of undulations, in the form of a continuous wave in the direction transverse to the paper, produced by the pressure of the leaf plate or produced by spreading of the undulations occurring at the place where ink attaches the paper, is reduced by the projections contacting the paper. More specifically, such action is developed such that the portions of the undulations in the paper which are close to the projections are lifted by the projections and the portions of them apart from the projections are pressed down by the troughs between the projections, in the direction of the height of the projection. Thus, the undulations produced in the paper are made even and the amplitude is greatly reduced. Accordingly, the distance between the nose portion of the ink jet printer and the paper becomes uniform and the printing quality is improved.

BRIEF DESCRIPTION OF THE DRAWINGS

FIG. 9(B1) is that obtained when high-density printing was performed using a conventional apparatus; FIG. 9(A2) is that obtained when the apparatus of the embodiment was used while printing was not performed; and FIG. 9(B2) shows that obtained when a conventional apparatus was used while printing was not performed;

DESCRIPTION OF THE PREFERRED EMBODIMENT

Figure 1:
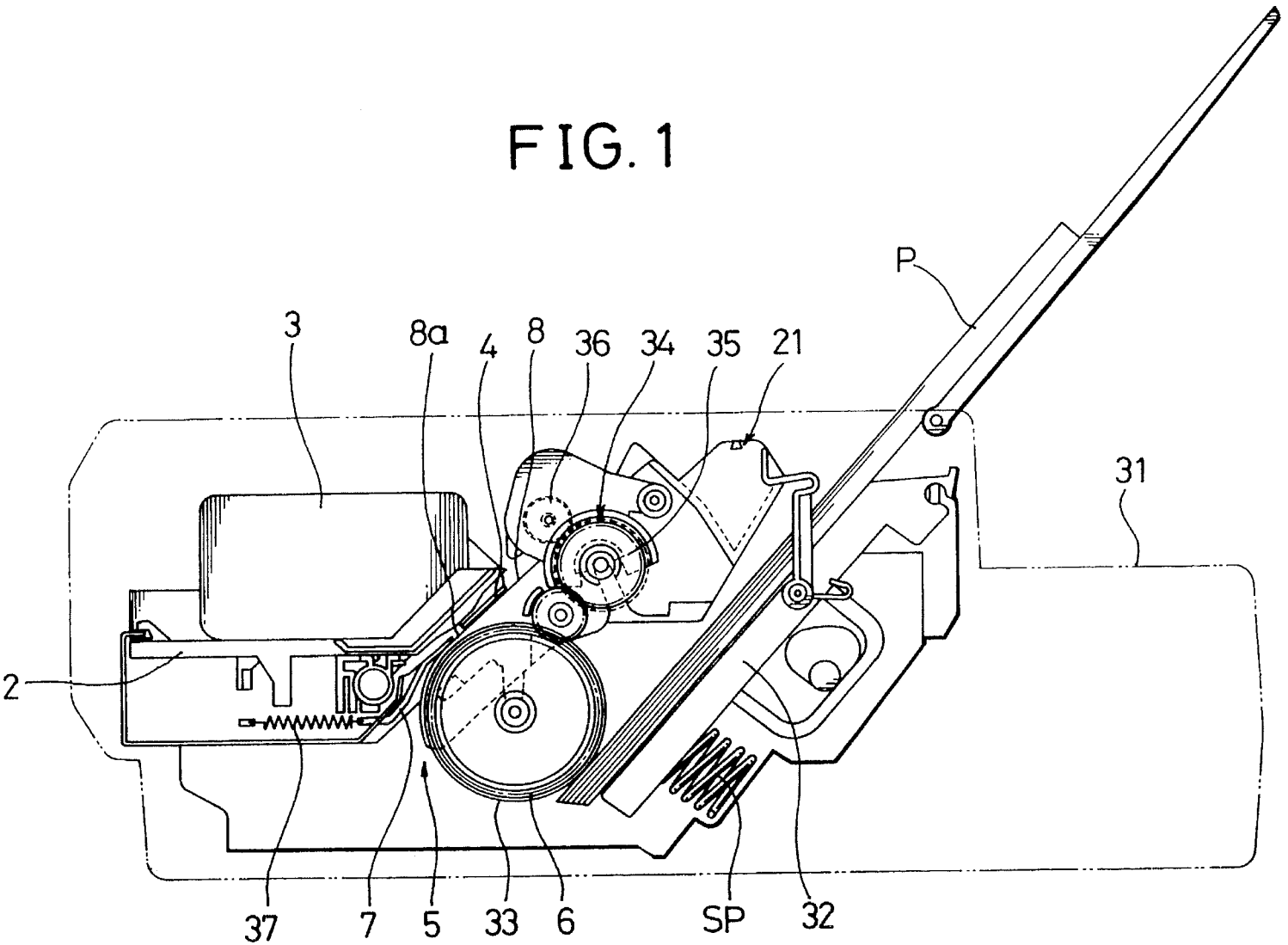
FIG. 1 is a side view of the internal structure in an embodiment according to the invention.
Figure 2:
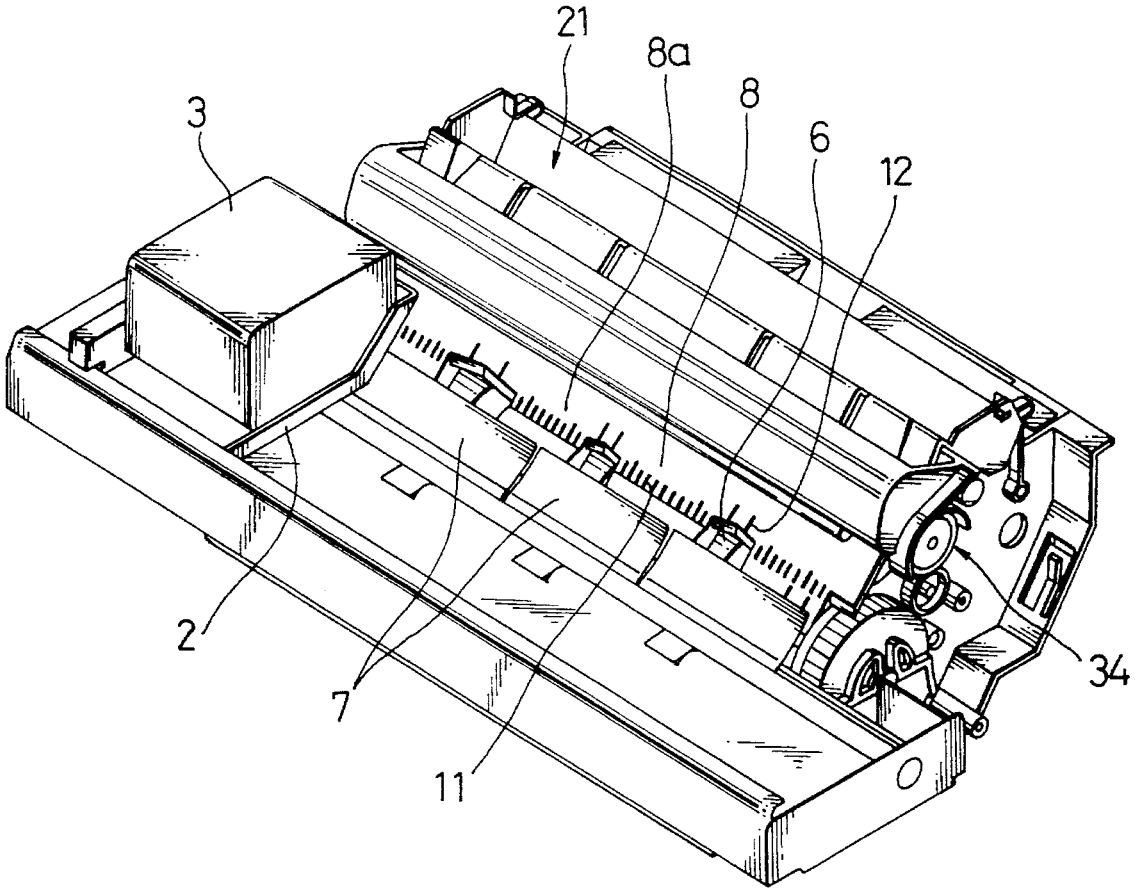
FIG. 2 is a perspective view of the same.

An embodiment of the invention will be described below with reference to the accompanying drawings. The ink jet printer according to the embodiment is similar in its basic structure to the example of the conventional ink jet printer described with reference to FIGS. 7 and 8. Accordingly, parts of the embodiment corresponding to the parts of the prior art shown in FIGS. 7 and 8 will be denoted by corresponding reference numerals and description of them will be omitted or only be given briefly.

The ink jet printer according to the embodiment is generally structured such that a plurality of projections (ribs 11, 12, and 15 in the embodiment) for reducing the amplitude of undulations occurring in printing paper are arranged spaced apart and transversely to the printing paper in a printing area 8*a* of the paper guide surface 8 corresponding to at least the traveling region of the nose portion 4 of the ink jet head 3. The printing area 8*a* here connotes the region between the place where the leaf plate 7 abuts on the feed roller 6 and the place where the nose portion 4 of the ink jet head 3 opposes the paper guide surface 8 including the regions overlapping with the abutting place and confronting place. A detailed description thereof will be given below.

Figure 3:
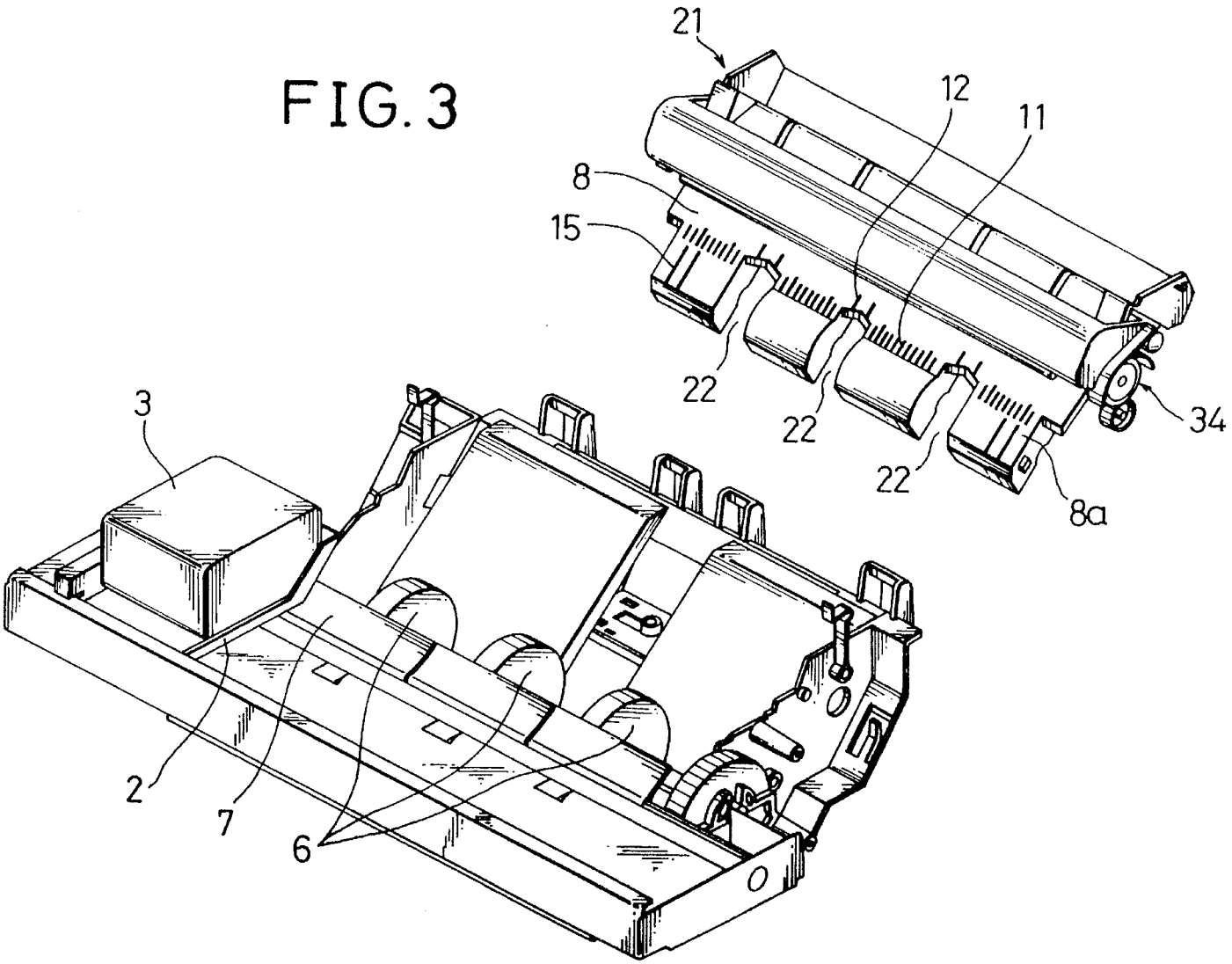
FIG. 3 is an exploded perspective view showing a paper guide unit detached from the body.

In the body of a case 31, there is formed a guide path 33 virtually in the shape of the letter U communicating a paper feed tray 32, containing printing paper P, provided in the paper feeding position and urged by a spring SP to the feed roller 6 with a paper discharge tray, not shown, provided in the paper discharging position. More specifically, the guide path 33 is formed of the feed roller 6 for feeding the printing paper P contained in the paper feed tray 32 and a paper guide unit 21 having the paper guide surface 8 for transporting the printing paper P fed by the feed roller 6 and discharging it into the paper discharge tray. The paper guide unit 21 here is structured to be detachable from the body of the apparatus as illustrated in FIG. 3 and has a paper discharge mechanism 34 in the guide path 33 downstream of the paper guide surface 8. The paper discharge mechanism 34 is formed of a paper discharge roller 35 and an urging roller 36 in confronting relationship across the guide path 33. The leaf plate 7 is disposed in a position not interfering with reciprocation of the carrier 2 mounting the ink jet head 3 thereon as illustrated in FIG. 1, and adapted to abut on the feed roller 6 by having its rear end urged by a spring 37.

The ribs 11 are arranged in the printing area 8*a* of the paper guide surface 8 so as to control the undulations produced in the printing paper P in the direction transverse to the printing paper (the direction indicated by the arrow Y in FIG. 4) to have minimum amplitude in the position opposite the nose portion 4 of the ink jet head 3. More specifically, the ribs 11 are arranged such that their ends are positioned 5.98 mm downstream from the leaf plate 7 in the guide path 33. The upstream portion 11*a* of each rib 11 is chamfered at a predetermined angle (30° in the present embodiment) with the paper guide surface 8 so that it does not abut on the front end of the printing paper P and assures smooth feeding of the paper. Accordingly, the aforesaid end portion of the rib 11 is the portion not chamfered. Each of the ribs 11 is designed to have a height from the paper guide surface 8 determined with the head gap of the nose portion of the ink jet head 3 and the thickness of the printing paper taken into consideration. More specifically, the height of each rib 11 is set to 1.35 mm. The distances E, F, G, and H of the ribs 11 are set to 4.66 mm, 4.25 mm, 4.54 mm, and 4.75 mm, respectively. Further, the second ribs 11 counted from the hollow portions 22 formed in the paper guide unit 21 and the third ribs 11 counted from both ends of the paper guide unit 21 are formed somewhat longer than the other ribs 11 in the direction of transportation of the printing paper P.

Figure 4:
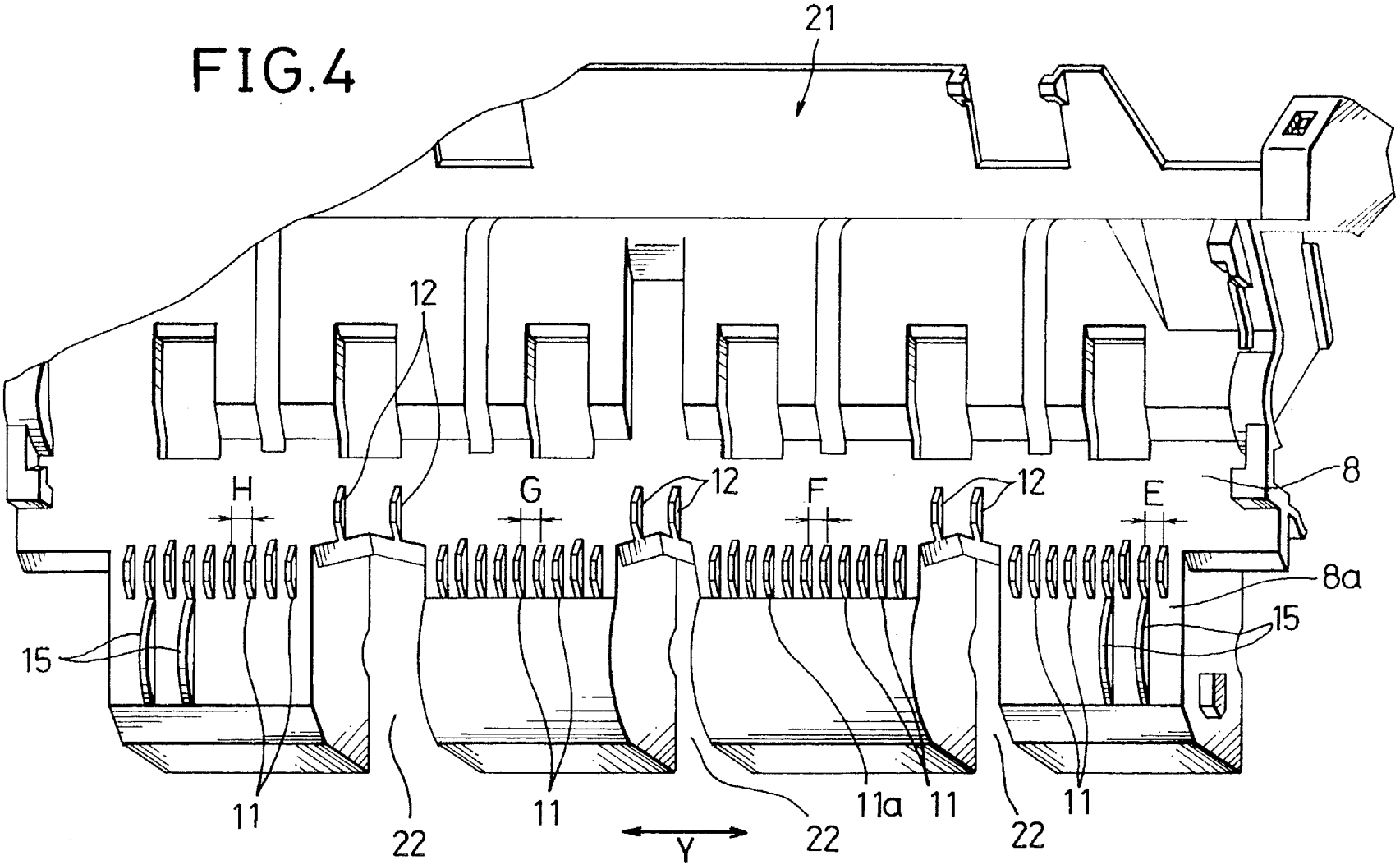
FIG. 4 is a perspective view of the paper guide unit.
Figure 5:
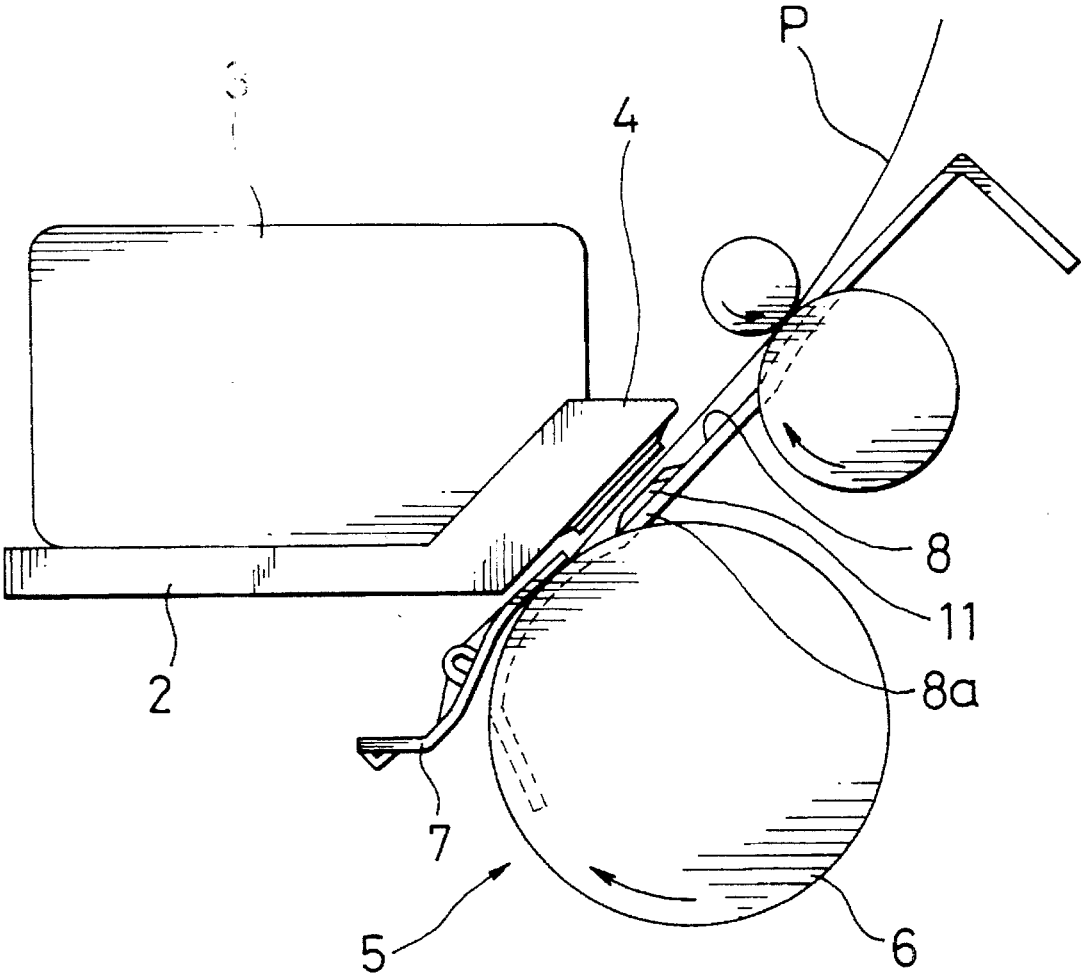
FIG. 5 is a side view showing relative positions of the feed roller, leaf plate, ink jet head, paper guide surface, and projections.
Figure 6:
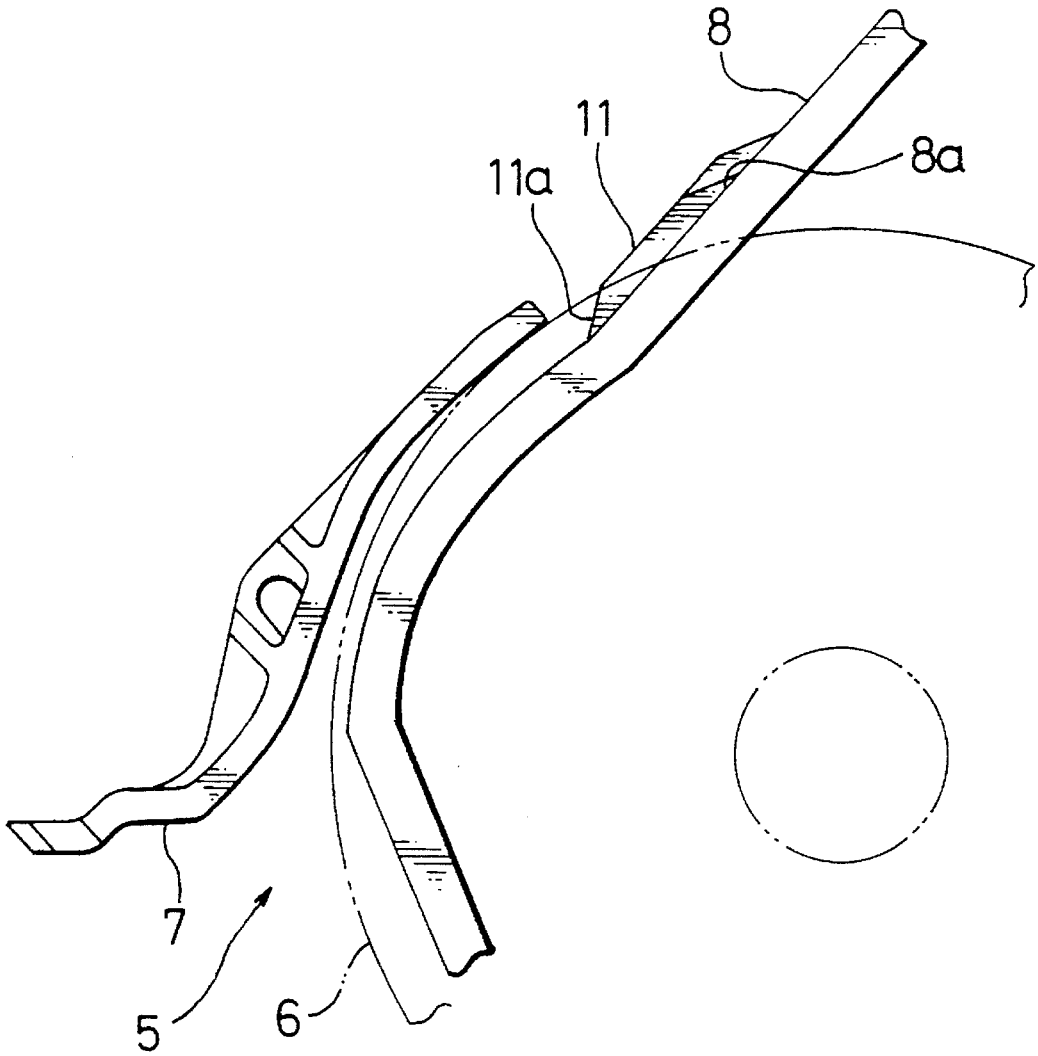
FIG. 6 is an enlarged side view of FIG. 5, showing relative positions of the feed roller, leaf plate, and projections.

Further, of the ribs 12 disposed at the portions of the paper guide surface 8 corresponding to the feed roller 6, those in the center and on the right-hand side in FIG. 4 are spaced apart by 7 mm and those on the left-hand side are spaced apart by 9.1 mm.

Reference numerals 15 denote auxiliary ribs disposed in the positions corresponding to both ends of the printing paper P fed by the feed roller 6.

The ribs 11, 12, and 15 have polished surfaces.

Figure 7A:
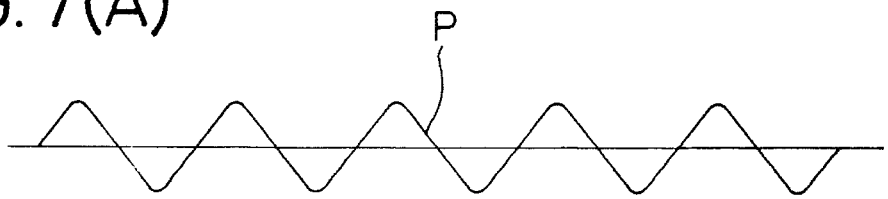
FIG. 7(A) is a sectional view of printing paper showing the state of the undulations produced in the paper.
Figure 7B:
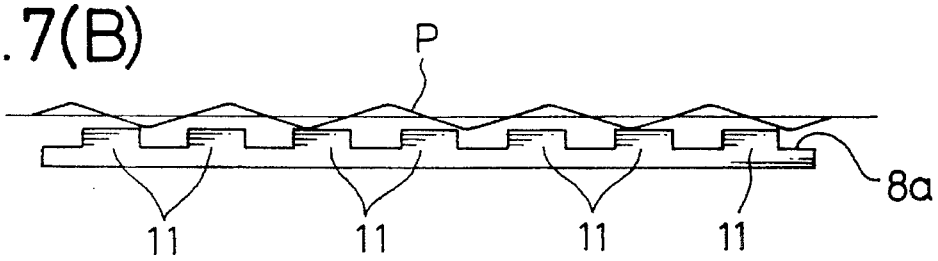
FIG. 7(B) is a sectional view of the printing paper showing the state in which the undulations are flattened by the projections.
Figure 8:
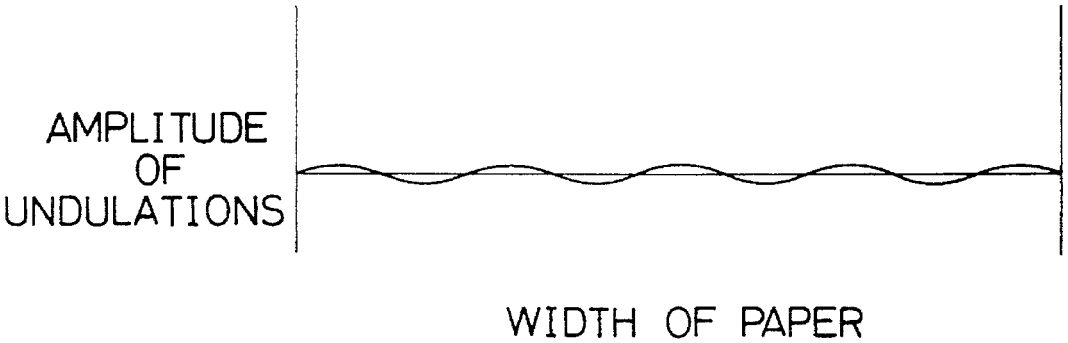
FIG. 8 is a sectional view of a printing paper showing the state of the undulations in the flattened paper.

In the above described structure, while the printing paper P moves in the direction longitudinal to the plurality of ribs 11 and 12 and auxiliary ribs 15 supported by these ribs 11 and 12 and auxiliary ribs 15, ink is jetted from the nose portion 4 of the ink jet head 3 to the printing paper P and printing is thereby performed. At this time, there are formed undulations in the printing paper P at the printing area 8*a* including the portion to which the ink is attached (i.e., printed portion) in the form of a continuous wave in the direction transverse to the printing paper P as shown in FIG. 7(A) due to the pressure of the leaf plate 7 or the ink attached to the printed portion. However, an action is developed that causes the portions of the undulations close to the paper guide surface 8 to be lifted by the plurality of ribs 11 and 12 and auxiliary ribs 15 and the portions apart from the paper guide surface 8 to be pressed down toward the paper guide surface 8 by the spacings between the ribs 11 and 12 as shown in FIG. 7(B). Further, since the printing paper P, which has been sent over to the paper guide surface 8 pressed against the feed roller 6 by the leaf plate 7, is adapted to be pressed against the ribs 11 at the printing portion, an action to cause the portions of the undulations produced in the printing paper P close to the paper guide surface 8 to be lifted and the portions apart from the paper guide surface 8 to be pressed down toward the paper guide surface 8 is promoted. Thus, the undulations are leveled and the amplitude is greatly reduced (at least to the half of that in the conventional apparatus.)

Accordingly, the printing gap between the nose portion 4 of the ink jet head 3 and the paper guide surface 8 at the printing position is maintained constant by the ribs 12 and, thus, the controlling effect of the ribs 11 on the undulations all over the printing area is secured.

Further, the printing gap between the nose portion 4 of the ink jet head 3 and the paper guide surface 8 in the printing position at both ends of the printing paper P is maintained constant by the ribs 15 supporting both ends of the printing paper P.

Further, since the second ribs 11 counted from the hollow portion 22 formed in the paper guide unit 21 and the third ribs 11 counted from both ends of the paper guide unit 21 are made somewhat longer in the direction of transportation of the paper than the other ribs 11, the trough portions of the larger undulations produced in the printing paper P due to the pressure of the leaf plate 7 on the feed roller 6 is held up and, hence, the amplitude of the undulations is reduced more effectively. Further, the amplitude of the undulations spread to the printing position due to the ink attached to the printing paper P can be reduced more effectively by the ribs 11 made longer than the other ribs 11.

Since, according to the present embodiment as described above, pluralities of ribs 11, 12, and 15 capable of reducing the amplitude of the undulations produced in the paper are disposed spaced apart in the direction transverse to the paper (in the Y direction) at least in the printing area 8*a* of the paper guide surface 8 corresponding to the area in which the ink jet head 3 travels, occurrence of the undulations in the paper producing adverse effects on the line being printed and the next line to the printed line can be greatly reduced. As a result, the quality of printing can be much improved.

Further, since the head gap at the top of the printing paper P can be kept accurate by the ribs 11 and 12, high quality printing can be achieved from the start of the printing.

Further, since the upstream end portion of the ribs 11 and 12 is at an angle of inclination of 30° with the paper guide surface 8, the front edge of the printing paper P is effectively prevented from being caught by these ribs 11 and 12 and smooth printing is thereby achieved. Furthermore, since the surfaces of the ribs 11, 12, and 15 are polished, the sound resulting from friction between the printing paper P and the ribs 11, 12, and 15 is reduced and thereby occurrence of printing noise can be prevented. Further, since the ribs 11 and 12 and the auxiliary ribs 15 are formed so as to be integral with the paper guide surface 8 of the paper guide unit 21, they can be fabricated easily and at low cost.

In addition, since the feed roller 6 is divided into three rollers, its material cost can be curtailed and, because the surface of friction between the feed roller 6 and the printing paper P is limited to the minimum necessary, the load on the motor can be reduced.

Figure 9:
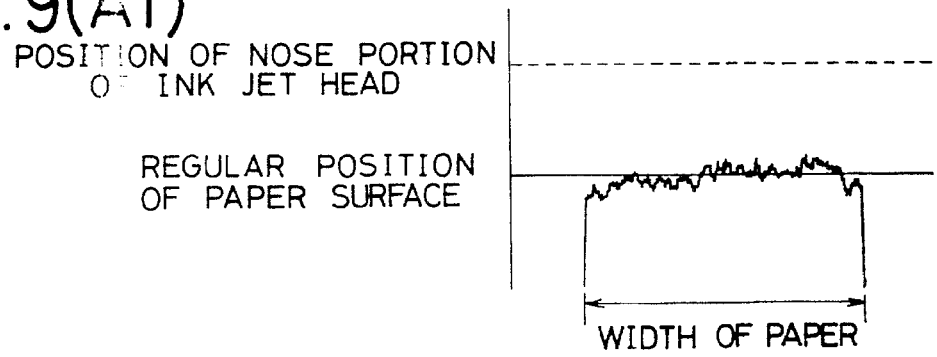
FIGS. 9(A1), 9(B1), 9(A2), and 9(B2) are graphs showing results of experiments indicating the distance between the nose portion of the ink jet head and printing paper, wherein FIG. 9(A1) is that obtained when high-density printing was performed using the apparatus of the embodiment.
Figure 9:
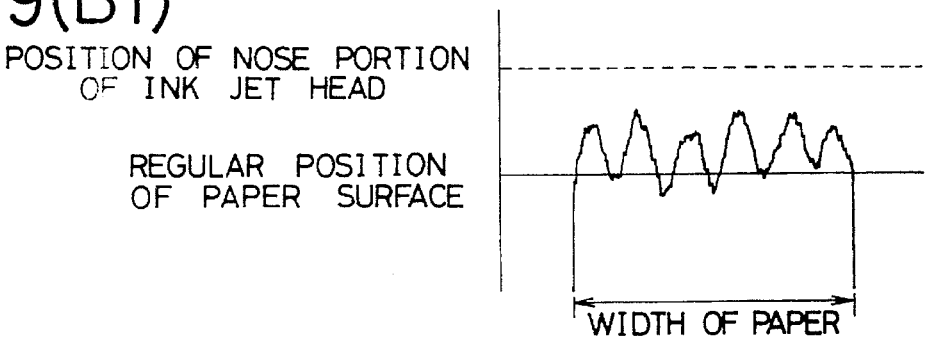
Figure 9:
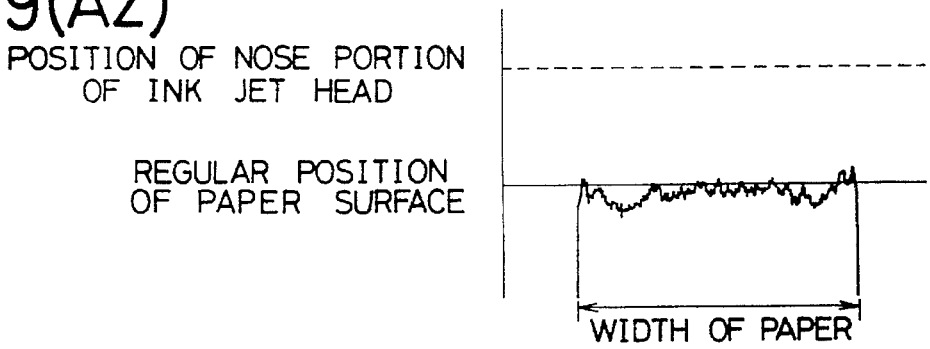
Figure 9:
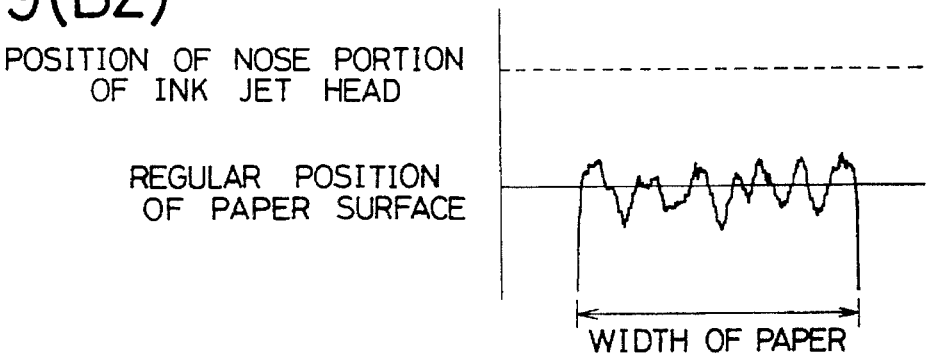
Figure 10:
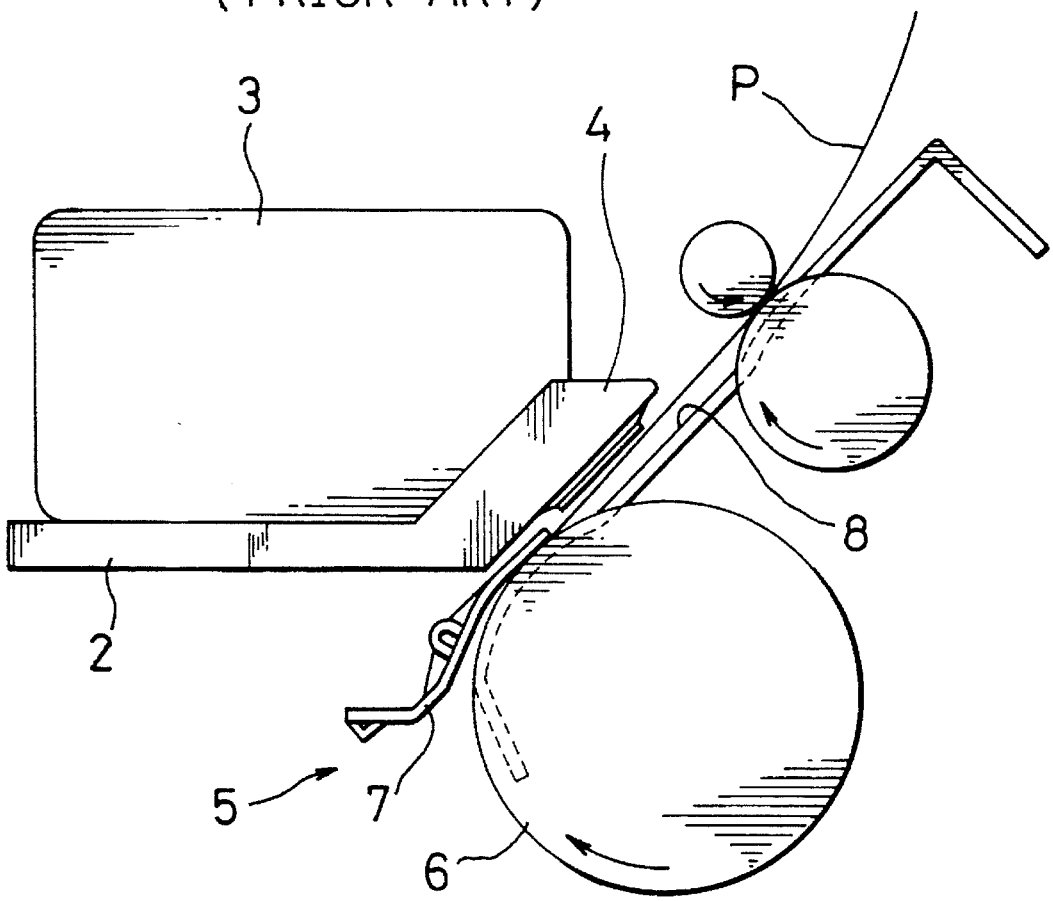
FIG. 10 (PRIOR ART)
FIG. 10 is a side view showing an example the of structure of a conventional ink jet printer.
Figure 11:
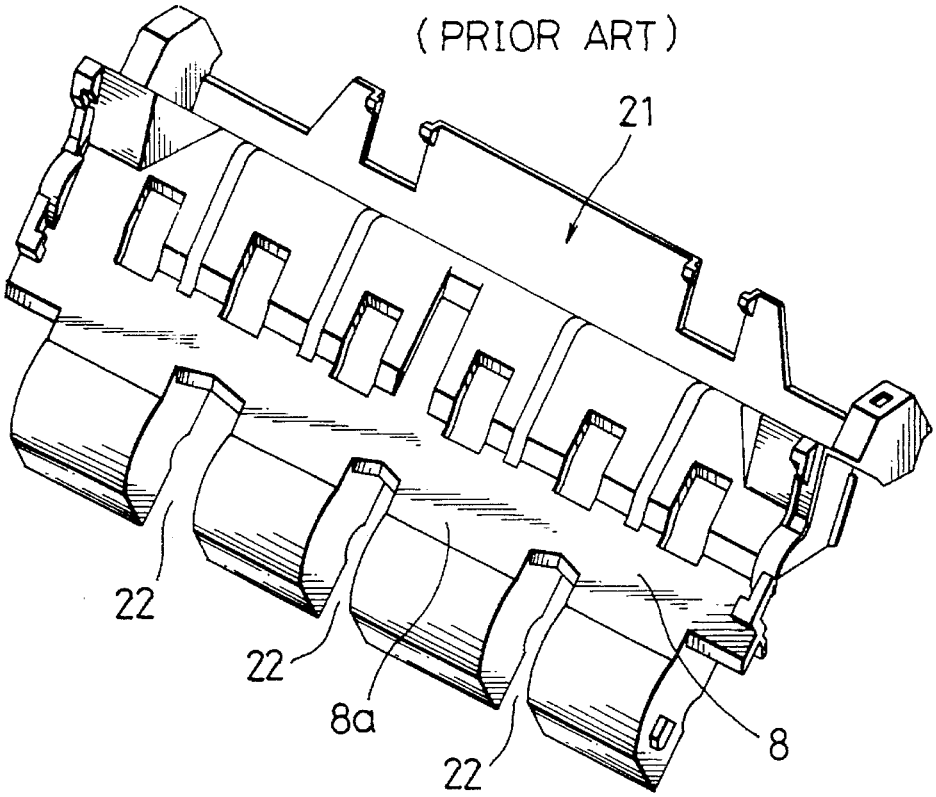
FIG.11 (PRIOR ART)
FIG. 11 is a perspective view of a paper guide unit.
Figure 12:
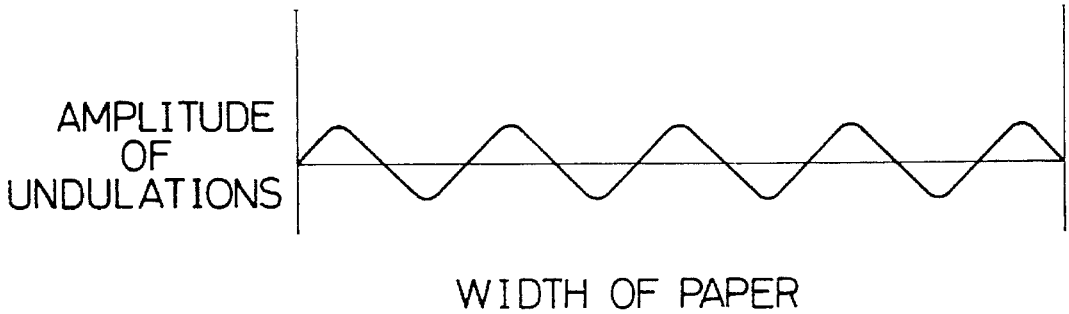
FIG.12 (PRIOR ART)
FIG. 12 is a sectional view of printing paper showing a state of the amplitude of undulations formed in printing paper.

In order to observe the state of the amplitude of the undulations produced in the printing paper P, this applicant conducted some experiments. As the printing paper P, Xerox-4024.201b in letter-size was used. The head gap between the printing paper P and the nose portion 4 of the ink jet head 3 was set to 1 mm and the printing speed in the printing position was set to 67.73 mm/sec. The results of experiment are as shown in FIGS. 9(A1), 9(B1), 9(A2), and 9(B2). FIGS. 9(A1), 9(B1), 9(A2), and 9(B2) are graphs in which the amplitude of the undulations produced in the printing paper P is indicated converted to voltage. FIG. 9(A1) and FIG. 9(B1) show the results of measurement obtained at the place one line upstream from the printing position when printing was performed in a high-density printing mode. FIG. 9(A2) and FIG. 9(B2) show the results of measurement obtained in the printing position when the printing paper P was placed in the guide path 33 and no printing was performed. FIG. 9(A1) and FIG. 9(A2) show the results obtained by using the apparatus of the embodiment and FIG. 9(B1) and FIG. 9(B2) show the results obtained by using a conventional apparatus. As clearly shown in these graphs, the amplitude of the undulations produced in the printing paper P when the conventional apparatus was used was the larger regardless whether printing was made on the printing paper P or not (FIGS. 9(B1) and 9(B2)). Especially when printing was made on the printing paper P, there were produced in the printing paper P undulations whose amplitude was so great as to reduce the head gap down to 0.4 mm (FIG. 9(B1)). On the other hand, when the apparatus of the embodiment was used, the amplitude produced in the printing paper P was small and therefore the head gap was virtually maintained within the prescribed range of 1 mm (FIGS. 9(A1) and 9(A2)).

What is claimed is:

1. An ink jet printer comprising:

a guide path guiding printing paper in a direction from a paper feeding side to a paper discharging side;

a feed roller having a peripheral surface thereof in contact with said guide path and rotating by being driven by a driving portion;

a leaf plate abutting said feed roller through said guide path;

a flat paper guide surface disposed in said guide path downstream of a position where said feed roller and said leaf plate are in contact and comprise a portion of said guide path;

an ink jet head having a nose portion jetting ink, said nose portion being disposed opposite to said paper guide surface across said guide path; and a plurality of projections disposed on said paper guide surface opposite a region between a position where said leaf plate contacts said feed roller and a position where said nose portion of said ink jet head opposes said paper guide surface and arranged at intervals in a direction transverse to said printing paper for interfering with said guide path such that undulations in the paper are leveled and an amplitude of the undulations is reduced.

2. The ink jet printer according to claim 1, wherein said projections are disposed at positions on said paper guide surface located opposite said nose portion of said ink jet head.

3. The ink jet printer according to claim 1, wherein said projections are spaced apart by 4 mm to 5 mm.

4. The ink jet printer according to claim 1, wherein said projections have polished surfaces.

5. The ink jet printer according to claim 1, wherein said ink jet head comprises a serial head, wherein said ink jet printer is reciprocable in the direction transverse to said printing paper.

6. An ink jet printer comprising:

a guide path guiding printing paper in a direction from a paper feeding side to a paper discharging side;

a feed roller having a peripheral surface thereof in contact with said guide path and rotating by being driven by a driving portion;

a leaf plate abutting said feed roller through said guide path;

a flat paper guide surface disposed in said guide path downstream of a position where said feed roller and said leaf plate are in contact and comprise a portion of said guide path;

an ink jet head having a nose portion jetting ink, said nose portion being disposed opposite to said paper guide surface across said guide path; and a plurality of projections disposed on said paper guide surface opposite a region between a position where said leaf plate contacts said feed roller and a position where said nose portion of said ink jet head opposes said paper guide surface and arranged at intervals in a direction transverse to said printing paper for interfering with said guide path such that undulations in the paper are leveled and an amplitude of the undulations is reduced;

wherein said feed roller is divided into a plurality of rollers, said paper guide surface is extended into the areas between said feed rollers, and said projections are formed in the areas to which said paper guide surface is extended.

7. The ink jet printer according to claim 6, wherein said projections disposed in proximity with said feed rollers are longer in the direction of transportation of said printing paper than remaining projections.

8. The ink jet printer according to claim 6, wherein said projections are also formed at positions downstream in said guide path from said feed rollers and adjacent to said feed rollers.

9. An ink jet printer comprising:

a guide path guiding printing paper in a direction from a paper feeding side to a paper discharging side;

a feed roller having a peripheral surface thereof in contact with said guide path and rotating by being driven by a driving portion;

a leaf plate abutting said feed roller through said guide path;

a flat paper guide surface disposed in said guide path downstream of a position where said feed roller and said leaf plate are in contact and comprise a portion of said guide path;

an ink jet head having a nose portion jetting ink, said nose portion being disposed opposite to said paper guide surface across said guide path; and a plurality of projections disposed on said paper guide surface opposite a region between the position where said leaf plate contacts said feed roller and a position where said nose portion of said ink jet head opposes said paper guide surface and arranged at intervals in a direction transverse to said printing paper for interfering with said guide path such that undulations in the paper are leveled and an amplitude of the undulations is reduced;

wherein said feed roller is divided into a plurality of rollers, and said paper guide surface is extended into areas between said rollers, and said ink jet printer includes auxiliary projections disposed in positions adjacent to the positions where said leaf plate contacts said feed rollers in said extended areas and contacting opposite side ends of said printing paper.

* * * * *